United States Patent [19]

Hoerauf et al.

[11] 4,202,375

[45] May 13, 1980

[54] PROCESS AND APPARATUS FOR ACHIEVING A UNIFORM FLOW PROFILE

[75] Inventors: Werner Hoerauf, Ludwigshafen; Hans Pirzer, Frankenthal; Ernst Guenther, Ludwigshafen; Eckart Neumann, Frankenthal; Ernst Dietrich, Worms, all of Fed. Rep. of Germany

[73] Assignee: BASF Aktiengesellschaft, Ludwigshafen, Fed. Rep. of Germany

[21] Appl. No.: 859,459

[22] Filed: Dec. 12, 1977

Related U.S. Application Data

[63] Continuation-in-part of Ser. No. 667,881, Mar. 18, 1976, abandoned.

[30] Foreign Application Priority Data

Mar. 29, 1975 [DE] Fed. Rep. of Germany ..... 2514129

[51] Int. Cl.[2] ..... F15D 1/02

[52] U.S. Cl. ..... 138/39; 366/338

[58] Field of Search ..... 138/37–40; 366/336, 338

[56] References Cited

U.S. PATENT DOCUMENTS

| | | | |
|---|---|---|---|
| 2,132,011 | 10/1938 | Bennett et al. | 138/40 |
| 3,075,559 | 1/1963 | Sharp et al. | 138/37 |
| 3,874,643 | 4/1975 | Lorenian | 366/338 X |

FOREIGN PATENT DOCUMENTS 1136310 3/1963 Fed. Rep. of Germany .

*Primary Examiner*—Charles E. Phillips
*Attorney, Agent, or Firm*—Keil & Witherspoon

[57] ABSTRACT

A process for achieving a uniform flow profile of very viscous liquids when flowing through tubes or reaction chambers, wherein the very viscous liquid is passed through annular spaces extending concentrically with increasing diameter over the entire cross-section of the tubes or reaction chambers and having the same depth in the direction of flow, and this procedure is repeated once or several times, the annular spaces being staggered with respect to each other as viewed in the direction of flow, and an apparatus consisting of a combination of two or more discs arranged at axial intervals within a tube transversely to the direction of flow, each disc consisting of a plurality of ring-shaped bands of increasing diameter, the bands being arranged freely of one another and concentrically at intervals on a grid supporting means to provide correspondingly concentric open spaces between the bands over the entire cross-section of the tube, with the walls of the bands running parallel to the direction of flow, and the bands of the separate discs being staggered with respect to each other as viewed in the direction of flow.

4 Claims, 3 Drawing Figures

PROCESS AND APPARATUS FOR ACHIEVING A UNIFORM FLOW PROFILE

This application is a continuation-in-part of U.S. patent application Ser. No. 667,881, filed Mar. 18, 1976 now abandoned.

When fluids of high viscosity flow through tubes or reaction chambers it is difficult to achieve a uniform flow profile, that is to say a uniform rate of flow over the entire cross-section. The effect of the wall on the flow is that the central part of the viscous fluid flows faster. As a consequence, the residence time of individual portions of the fluid in the tube or reaction chamber differs and a large proportion of the fluid only leaves the tube or the reaction chamber after a longer time than the parts of the fluid which are in the middle zone. This is undesirable if a reaction takes place in the fluid and its progress depends on the residence time. Particularly in the case of polymerization reactions or polycondensation reactions, e.g. in the case of the manufacture of polycaprolactam, a variable residence time results in a substantially broader spectrum of constituents of higher molecular weight and lower molecular weight.

German Pat. No. 1,136,310 discloses a device for achieving a uniform flow profile, wherein cylindrical packings, held together in a hexagonal arrangement to form discs, are provided with inward-projecting wall cut-outs and the discs are fitted at intervals, at right angles to the direction of flow, into the tube or reaction chamber through which the fluid flows.

The object of this invention is to provide a process which achieves a uniform flow in highly viscous liquids. It is another object of the invention to provide open spaces which are uniform over the entire cross-section of the flow tube or reaction chamber. Yet another object of the invention is to ensure that no dead spaces are formed. Finally, it is an object of the invention to provide a suitable apparatus therefor.

In accordance with this invention, these and other objects are achieved in a process for obtaining a uniform flow profile of very viscous liquids when flowing through tubes or reaction chambers, wherein the very viscous liquid is passed through annular spaces extending concentrically with increasing diameter over the entire cross-section of the tubes or reaction chambers and having the same depth in the direction of flow, and this procedure is repeated once or several times, the annular spaces being staggered with respect to each other as viewed in the direction of flow.

The process according to the invention is achieved by means of an apparatus for obtaining a uniform flow profile of a highly viscous liquid when flowing through a tube, and consisting of a combination of two or more discs arranged at axial intervals within said tube transversely to the direction of flow, each disc consisting of a plurality of ring-shaped bands of increasing diameter, the bands being arranged freely of one another and concentrically at intervals on a grid supporting means to provide correspondingly concentric open spaces between the bands over the entire cross-section of the tube, with the walls of the bands running parallel to the direction of flow, and the bands of the separate discs being staggered with respect to each other as viewed in the direction of flow.

Preferred very viscous fluids are, e.g., polylactam melts which are obtained on polycondensation of lactams of 5 to 13 ring members of from 140° to 250° C.

The process and the apparatus are of particular industrial importance in connection with the manufacture of polycaprolactam.

In accordance with the invention, the very viscous liquid is passed through annular spaces. The width of the spaces is advantageously from 1.75 to 5 cm. The spaces extend concentrically with increasing diameter over the entire cross-section of the tube or reaction chamber. The term "concentrically" means that the distance between any one annular space and the axis of the tube or reaction chamber is the same at all points, and the distance between any one annular space and the walls of the tube or reaction chamber is the same at all points. The annular spaces are formed by concentrically arranged ring-shaped bands of increasing diameter. The width of all the bands of any one disc is the same. The walls of the ring-shaped bands run parallel to the direction of flow of the very viscous liquid and consequently parallel to the walls of the tube or reaction chamber. In accordance with the invention, the annular spaces have the same depth in the direction of flow and run parallel, as viewed in the direction of flow. As the very viscous liquid flows through the tube or reaction chamber, it is passed twice or more times through annular spaces extending concentrically with increasing diameter over the entire cross-section of the tube or reaction chamber, the second and subsequent annular spaces being staggered with respect to the preceding annular space. The depth of the annular spaces in the direction of flow is advantageously from 1.5 to 10, especially 3.5 to 8, cm. Once the depth has been selected, it remains the same for all the annular spaces of a disc over the entire cross-section of the tube or reaction chamber. As a rule, the width of the annular spaces, i.e., the distance between the bands, is constant over the entire cross-section of the tube or reaction chamber. However, it is also possible for the width of the annular spaces to increase or decrease with increasing diameter so as to counterbalance a change in the flow characteristics of the melt, as may arise, for instance, through additional internal or external heating.

The very viscous liquid flows at least twice through concentric annular spaces extending over the entire cross-section of the tube or raaction chamber. The annular spaces are advantageously from 3.5 to 20 cm apart, in the direction of flow. It has proved to be particularly advantageous to pass the highly viscous melt through annular spaces from 4 to 10 times per meter of reaction chamber.

The new apparatus consists of 2 or more discs arranged at axial intervals within a tube or reaction chamber transversely to the direction of flow. Advantageously, the distance, in the direction of flow, between the discs is from 3.5 to 20 cm. It has proved advantageous to use from 4 to 10 discs per meter length, in reaction chambers. In another advantageous embodiment, the discs are solely separated from one another by the support structure (described in more detail below) which serves as a spacer. In a vertical reaction chamber, therefore, only the support structure of the bottom disc is attached to the walls of the chamber, or simply placed on an annular bead in the wall of the tube or reaction chamber, and the remaining discs with their support structures are placed on top.

Each disc consists of a plurality of ring-shaped bands of increasing diameter, the bands being arranged freely of one another and concentrically at intervals on a grid supporting means. The ring-shaped bands are preferably from 1.5 to 10 cm wide, and especially from 3.5 to 8 cm wide. The distance between the individual ring-shaped bands is advantageously from 1.75 to 5 cm. As a rule, the distances between the individual ring-shaped bands are constant. However, it is also possible to arrange the ring-shaped bands, of increasing diameter, at larger or smaller distances so as to counterbalance a change in the flow characteristics of the melt, as may arise, e.g., through additional internal or external heating. In order to prevent the viscous fluid in the center of the disc from moving faster, a displacer body is advantageously provided there, the body preferably having conical ends.

To prevent the concentrically arranged bands from moving, they are attached, e.g., by welding, to a grid-like support. The support is for example a wide-meshed grid consisting of profiles, or a sheet metal grid, the walls of which run parallel to the direction of flow. The supporting means may also be of spider-like design. To fix the position of the individual discs in the tube or reaction chamber, it is possible to attach each supporting means to the wall of the tube or reaction chamber. Advantageously, however, only the first and last supporting means are attached; the intermediate discs are, if located closely together, automatically held in place transversely to the direction of flow. In a vertical tube or reaction chamber, only the bottom grid-like supporting means need be attached to the wall of the tube; the remaining discs and supporting means are then placed on top of the bottom disc.

It has proved particularly advantageous to provide the ring-shaped bands with wall cut-outs (as in the case of conventional packing rings) which project into the spaces between the individual ring-shaped bands and are generally arranged, as the bands themselves, parallel to the direction of flow. Depending on the width of the band, the wall cut-outs may be arranged in one row or more, e.g., 2 rows. As a rule, there are from 40 to 125 wall cut-outs per meter of band. A beneficial effect on the flow of very viscous fluids is achieved if the wall cut-outs arranged at right angles to the direction of flow are three-dimensionally twisted in the manner of a plowshare. The twist is shaped like the beginning of a left-hand or right-hand helix. The cut-outs can therefore be twisted in the manner of a plowshare, alternating in the sense of a left-hand helix and a right-hand helix from disc to disc and from band to band. In a particularly advantageous arrangement, the wall cut-outs in a first disc are twisted as in a left-hand helix, whilst in the next disc the wall cut-outs are twisted as in a right-hand helix.

It is also possible for the wall cut-outs in a first disc to point inwards, i.e., toward the axis of the reaction chamber, and in a second disc (viewed in the direction of flow) for them to point outwards, i.e., toward the wall of the tube or reaction chamber. It has also proved advantageous so to construct the wall cut-outs that they serve as spacers between the individual ring-shaped bands.

The new apparatus may be explained with reference to the following figures.

Figure 1:
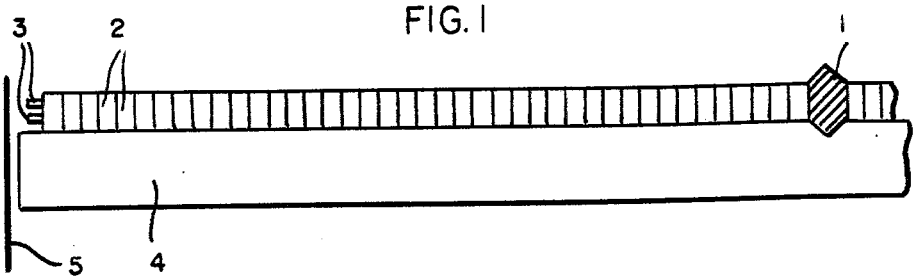
FIG. 1 shows a cross-section through a disc.

In FIG. 1, the displacer body (1) with conical top and bottom ends is attached to the supporting means (4) for example by welding. The supporting means (4) is for instance a wide-meshed grid of sheet metal arranged parallel to the direction of flow. The ring-shaped bands (2) are concentrically arranged around the displacer body (1) with increasing diameter, each band being the same distance from the next, and attached to the supporting means (4). The ring-shaped bands have wall cut-outs (3). For the sake of clarity, only the wall cut-outs of the last band before the reactor wall (5) are shown. The right-hand portion of FIG. 1 (not shown) is of course completely symmetrical with the left-hand portion. The attachment of the supporting means (4) to the reactor wall (5) is not shown in FIG. 1 either, because in the case of vertical tubes advantageously only the bottom supporting means is attached to the reactor wall.

Figure 2:
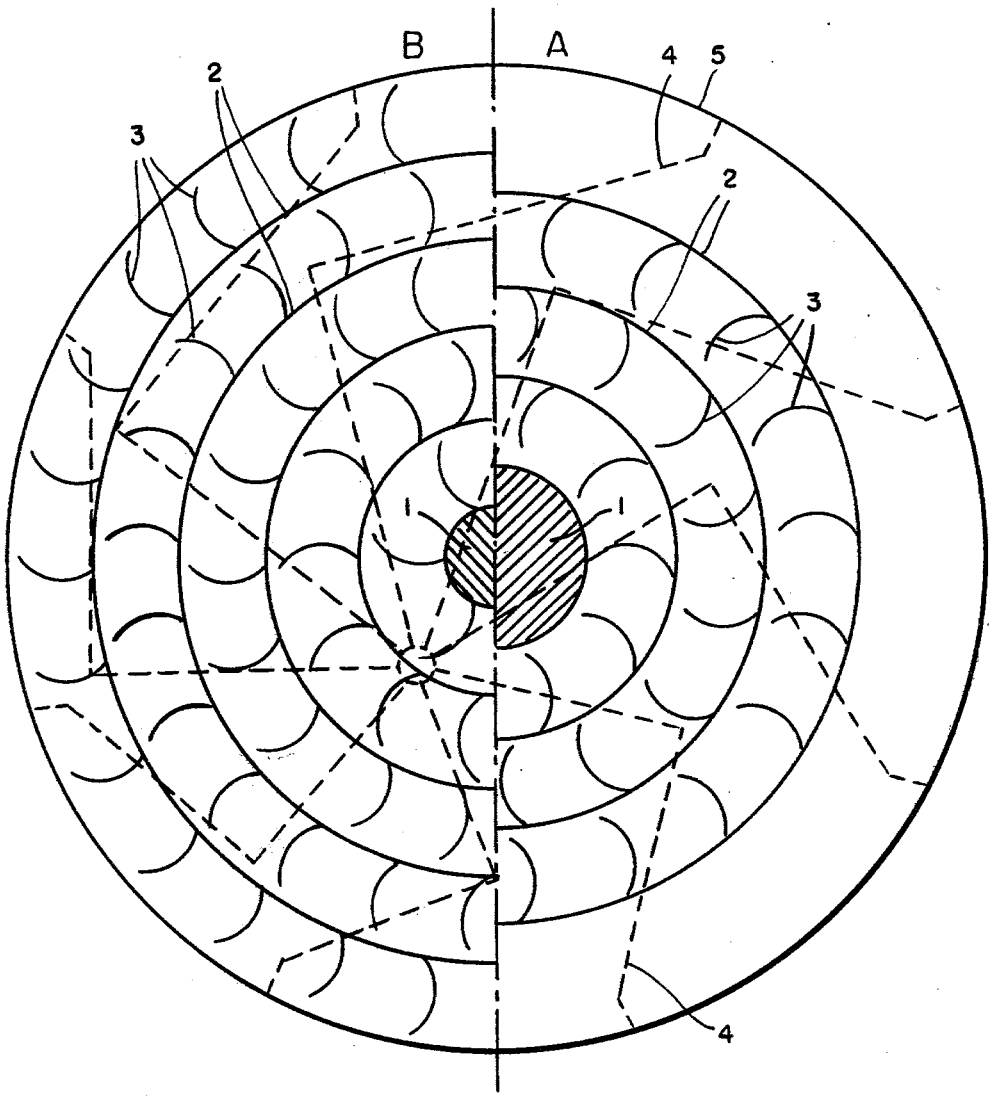
FIG. 2 shows a plan view of two mutually staggered discs, of each of which only one half is shown.

In FIG. 2, two discs A and B are arranged one in front of the other inside the reactor wall (5). Discs A and B each consist of a displacer body (1), concentrically arranged ring-shaped bands (2) and wall cut-outs (3). For the sake of clarity, only the right-hand half of disc A and only the left-hand half of disc B are shown. In disc A, the wall cut-outs (3) point inwards, i.e., toward the displacer body (1), whereas, in disc B, the wall cut-outs (3) point outwards, i.e., toward the reactor wall (5). The supporting means (4) has a spider-like shape and is shown as dashed lines. Again for the sake of clarity, only the supporting means for one disc is shown. The ring-shaped bands of disc A and those of disc B are of course attached to the same kind of supporting means (4). The attachment of the supporting means (4) to the reactor wall (5) is not shown either, as the manner in which it is attached is adapted to existing conditions.

Figure 3:
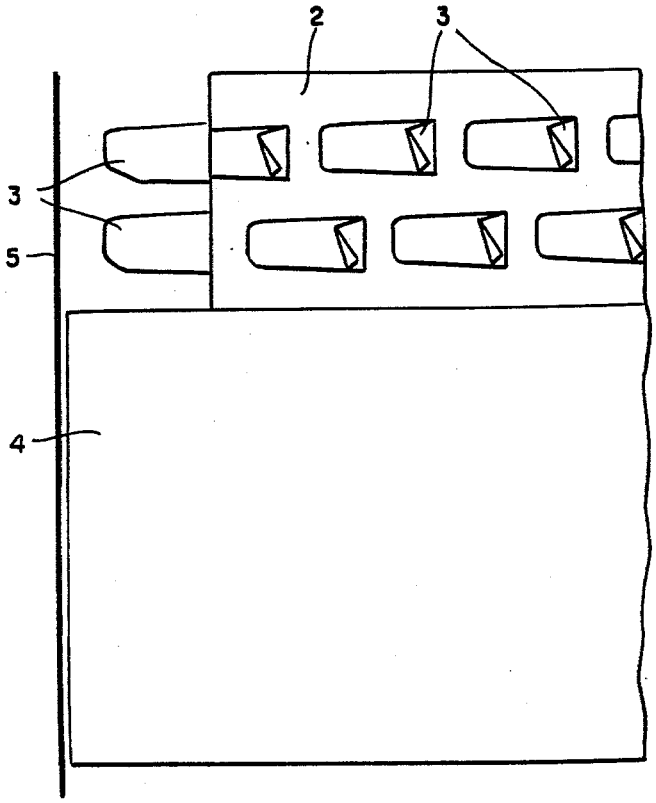
FIG. 3 shows an enlarged part section of FIG. 1.

FIG. 3 shows a part section of FIG. 1, the ring-shaped band being attached to the grid-like supporting means (4). The ring-shaped band has 2 rows of wall cut-outs (3) which are twisted. FIG. 3 is limited on the left-hand side by the reactor wall (5). For the sake of clarity, the attachment of the supporting means (4) to the reactor wall (5) is not shown.

We claim:

1. Apparatus for achieving a uniform flow profile of a very viscous fluid when flowing through a tube comprising in combination a flow tube, at least two discs arranged at axial intervals within said flow tube transversely to the direction of flow, each disc consisting of a plurality of ring-shaped bands of increasing diameter, the bands being arranged freely of one another and concentrically at intervals on a grid supporting means of said tube to provide correspondingly concentric open spaces therebetween over the entire cross-section of the tube, with the walls of the bands running parallel to the direction of flow, and the bands of the separate discs being staggered with respect to each other as viewed in the direction of flow and being provided with wall cut-outs which project into the annular spaces between the individual ring-shaped bands and are arranged with a three-dimensional twist to the left or right of and parallel to the direction of flow.

2. Apparatus as claimed in claim 1, wherein the wall cut-outs alternate in the sense of a left-hand and a right-hand twist from band to adjacent band and from disc to adjacent disc.

3. Apparatus as claimed in claim 1, wherein the wall cut-outs project inwardly and outwardly alternately from disc to adjacent disc.

4. Apparatus as claimed in claim 1, wherein the wall cut-outs also act as spacers between the individual ring-shaped bands of each disc.

* * * * *